US011325021B1

(12) United States Patent
McCosker

(10) Patent No.: US 11,325,021 B1
(45) Date of Patent: May 10, 2022

(54) SIDE RAILS FOR SELF-STABILIZING, ONE-WHEELED ELECTRIC SKATEBOARDS AND RELATED PRODUCTS

(71) Applicant: Float Supply LLC, Sacramento, CA (US)

(72) Inventor: Jeffrey McCosker, Sacramento, CA (US)

(73) Assignee: Float Supply LLC, Sacramento, CA (US)

( * ) Notice: Subject to any disclaimer, the term of this patent is extended or adjusted under 35 U.S.C. 154(b) by 0 days.

(21) Appl. No.: 17/470,111

(22) Filed: Sep. 9, 2021

Related U.S. Application Data

(60) Provisional application No. 63/177,763, filed on Apr. 21, 2021.

(51) Int. Cl.
*A63C 17/00* (2006.01)
*A63C 17/12* (2006.01)
*A63C 17/01* (2006.01)

(52) U.S. Cl.
CPC ..... *A63C 17/12* (2013.01); *A63C 17/014* (2013.01); *A63C 2203/12* (2013.01); *A63C 2203/42* (2013.01)

(58) Field of Classification Search
CPC ... A63C 17/12; A63C 17/014; A63C 2203/12; A63C 2203/42; A63C 17/08
See application file for complete search history.

(56) References Cited

U.S. PATENT DOCUMENTS

| | | | | |
|---|---|---|---|---|
| 7,811,217 | B2 * | 10/2010 | Odien | A63C 17/12 482/147 |
| 9,101,817 | B2 | 8/2015 | Doerksen | |
| D746,928 | S | 1/2016 | Doerksen | |
| D769,997 | S | 10/2016 | Doerksen | |
| 9,598,141 | B1 * | 3/2017 | Doerksen | H02K 9/22 |
| 9,643,077 | B2 * | 5/2017 | Bigler | A63C 17/08 |
| D795,374 | S * | 8/2017 | Bigler | A63C 17/12 D21/765 |
| 10,293,243 | B1 * | 5/2019 | Doerksen | A63C 17/016 |
| 10,369,453 | B2 * | 8/2019 | Bigler | A63C 17/014 |
| 10,456,658 | B1 * | 10/2019 | Doerksen | A63C 17/08 |
| 10,549,807 | B2 * | 2/2020 | Drossman | B60K 7/0007 |
| D881,307 | S | 4/2020 | Doerksen | |
| D881,308 | S | 4/2020 | Doerksen | |
| D890,278 | S * | 7/2020 | Doerksen | D21/763 |
| D890,279 | S | 7/2020 | Doerksen | |
| 10,717,490 | B1 * | 7/2020 | Orehek | A47G 27/0231 |

(Continued)

*Primary Examiner* — Hau V Phan
(74) *Attorney, Agent, or Firm* — Weintraub Tobin

(57) ABSTRACT

Novel side rails for self-stabilizing, one-wheeled electric skateboards and related products are disclosed. The angled frame rails of this invention and disclosure lower the center of gravity at the contact points—i.e. a rider's feet on the footpads—by as much as possible without losing any clearance at the front and rear bumpers, and tilt the gyroscope to change the zero-degree level default position. In order to achieve this, the inventive rails herein change to a downward tilt as soon as possible after the axle bolt connection points, then tilt back up before the footpad decks and continue through the front and rear of the vehicle. In one embodiment, a five-degree downward tilt of the rails allows for an approximately one-half inch drop in the center of gravity of the vehicle, thus increasing speed, stability, and safety.

12 Claims, 5 Drawing Sheets

(56) References Cited

U.S. PATENT DOCUMENTS

| | | | | | |
|---|---|---|---|---|---|
| D896,906 | S | * | 9/2020 | Doerksen | D21/771 |
| D897,469 | S | * | 9/2020 | Doerksen | D21/771 |
| 10,786,726 | B2 | * | 9/2020 | Doerksen | G01C 19/42 |
| 2019/0176646 | A1 | * | 6/2019 | Doerksen | B62K 11/007 |

* cited by examiner

SIDE RAILS FOR SELF-STABILIZING, ONE-WHEELED ELECTRIC SKATEBOARDS AND RELATED PRODUCTS

CROSS-REFERENCE TO RELATED APPLICATIONS

This application claims priority under 35 U.S.C. Section 119(e) to U.S. Provisional Patent Application No. 63/177,763, filed on Apr. 21, 2021, the entire disclosure of which is incorporated herein by reference.

FIELD OF THE INVENTION

The present invention and disclosure is generally directed to new and novel side rails for self-stabilizing one-wheel electric vehicles.

BACKGROUND OF THE INVENTION

Self-stabilizing, one-wheeled electric skateboards or vehicles and related products and accessories, such as the Onewheel® made by Future Motion, Inc., are fast becoming popular.

All known models of these one-wheeled electric skateboards require a frame to house the components. Historically, these models have all used a straight rail design, which keeps all of the components level and on the same x-axis plane.

In addition to the stock straight rails which come included on most one-wheeled electric skateboards, there are a few aftermarket replacement rails which have been made and sold, for example, by third-party accessory companies such as Ruckus Rails and Flight Fins.

These aftermarket rails have been designed to correct some of the issues with the straight stock rails. Those issues can include, without limitation, weak threads, low quality aluminum, rail length limiting tire options, fixed axle height attachments that limits ability for custom clearance, lack of color options, and poor tolerance. However, even after accounting for all these, every iteration of stock and aftermarket rails have still used a straight, level frame rail. And, using a straight, level frame rail still does not correct for a number of issues.

For example, the first downside to having a straight, level frame rail is that while riding a one-wheeled electric skateboard or vehicle, it puts the rider's feet high above the center axle balance point which causes instability while turning. This instability causes wobbles while riding the vehicle and is a contributing factor to crashes and injuries.

The high center of gravity significantly inhibits the rider's ability to aggressively carve, or turn, their vehicle at high speeds due to the fact the rider cannot shift their weight too far off center without the vehicle wobbling and possibly rolling over.

The only known device on the market that attempts to correct this issue is the Ignite Lift and Lowering kit. However, this product still relies on using the straight stock rails in order to lower the center of gravity. Also, by using this kit, the vehicle is now significantly lower to the ground at the front and rear bumpers which greatly reduces ground clearance and makes the vehicle much more difficult to ride.

Another downside to having straight rails is the rider's feet tend to slip off the front and rear of the footpads, causing falls and injury. Certain products attempt to correct this issue by adding a large kick-tail to the rear footpad to reduce the chances of foot slippage.

However, all of these products still rely on using the straight, level frame rails. They also only correct for the rear footpad and cannot correct for the front footpad. The reason they cannot correct for the front footpad is due to the fact that there is a weight activation sensor in the front foot pad deck so you cannot swap it out and have the vehicle still function.

Another downside to straight rails relates to how a one-wheeled electric skateboard specifically rides with the programming built into its software. There are a limited number of ride modes an end user can utilize to make the one-wheeled electric skateboard ride uniquely. These ride modes are called digital shaping. In every single digital shaping, once speeds in excess of sixteen mph are reached, the one-wheeled electric skateboard tilts back with what is called "pushback" and causes it to ride with the front higher in the air in relation to the rear, making it impossible to have the board level at speed.

This is a problem as it causes rider strain and reduces the performance of the one-wheeled electric skateboard. Pushback is a safety feature built into the software to keep beginner riders safe and cannot be changed by the end user with any of the digital shaping settings or products on the market.

Therefore, there exists a need for a new and novel rail frame design that solves these issues.

BRIEF SUMMARY OF THE INVENTION

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein.

In one embodiment, the angled frame rails of this invention and disclosure lower the center of gravity at the contact points—i.e. a rider's feet on foot pad decks—by as much as possible without losing any clearance at the front and rear bumpers, and tilt the gyroscope to change the zero-degree level default position to five degrees. In order to achieve this, the inventive side rails herein change to a downward tilt as soon as possible after the wheel connection points, then tilt back up before the footpad deck attachment points and continue through the front and rear of a one-wheeled electric skateboard or similar vehicle, such as the Onewheel®.

In one example embodiment, the inventive side rails herein change to a five-degree downward tilt as soon as possible after the wheel connection points, then tilt back up five degrees before the footpad deck attachment points and continue through the front and rear of a one-wheeled electric skateboard or similar vehicle.

The downward tilt of these angled side rails allows for an approximately one-half inch drop in the center of gravity of the one-wheeled electric skateboard. This allows for a significant improvement in the stability and safety of the one-wheeled electric skateboard. The upward tilt then brings the front and rear bumpers back up to the same level as with the straight frame rails, thereby making the angled rails lose little to no clearance whatsoever in relation to the straight frame rails.

The upward tilt also solves for the problem of the rider's feet slipping off the front and rear of the footpads, causing falls and injury, as it positions the footpad decks at a net ten degrees opposite from each other allowing the riders feet to more firmly grip the footpad decks and prevent slippage off the front and rear of the one-wheeled electric skateboard.

The upward tilt also solves the problem of how a one-wheeled electric skateboard rides with the programming built into the software as it changes the default position of the gyroscope.

In one example embodiment, if the side rails herein change to a five-degree downward tilt as soon as possible after the wheel connection points, then tilt back up five degrees, this allows a one-wheeled electric skateboard to now operate at a maximum seven degrees nose down angle which could not be achieved through any other method currently on the market and previously was limited to two degrees though the custom digital shaping mode.

The only way to achieve this without a software change is through a mechanical tilting of the gyroscope as it is currently not possible to accomplish this through software changes by the end user.

The ability to ride a one-wheeled electric skateboard above sixteen miles per hour on a level plane without pushback has been a highly demanded feature. However, some models introduce pushback at a more aggressive angle and activate it at a lower speed making it more pronounced and uncomfortable for the rider. Reducing pushback is a key milestone in order to comfortably and safely ride near the upper limits for expert riders.

Thus, in one embodiment, the angled frame rails of this invention and disclosure increase the speed, stability, and safety of one-wheeled electric skateboard, such as the One-wheels®.

The angled frame rails of this invention and disclosure can also be used on other one-wheeled electric skateboards or similar vehicles. For example, in another embodiment, the angled frame rails of this invention and disclosure can also be used with the Trotter MagWheel. The Trotter Mag-wheel suffers from the same problems as the Onewheel®, so it will benefit in a similar manner.

In other embodiments, the angled frame rails of this invention and disclosure can also be used on the TFL Balance Board. The rails will lower the center of gravity and grip the wobble cushion better and make the TFL Balance Board more beginner friendly. The increased ease of use will allow beginner users to more confidently train and learn to use the TFL Balance Board.

Other objects, features, and advantages of the present invention will become apparent upon consideration of the following detailed description and the accompanying drawings.

DETAILED DESCRIPTION OF THE INVENTION

The following is a detailed description of embodiments to illustrate the principles of the invention. The embodiments are provided to illustrate aspects of the invention, but the invention is not limited to any embodiment. The scope of the invention encompasses numerous alternatives, modifications, and equivalents. The scope of the invention is limited only by the claims.

While numerous specific details are set forth in the following description to provide a thorough understanding of the invention, the invention may be practiced according to the claims without some or all of these specific details.

Various embodiments will be described in detail with reference to the accompanying drawings. Wherever possible, the same reference numbers are used throughout the drawings to refer to the same or like parts. References made to particular examples and implementations are for illustrative purposes and are not intended to limit the scope of the claims.

Figure 1:
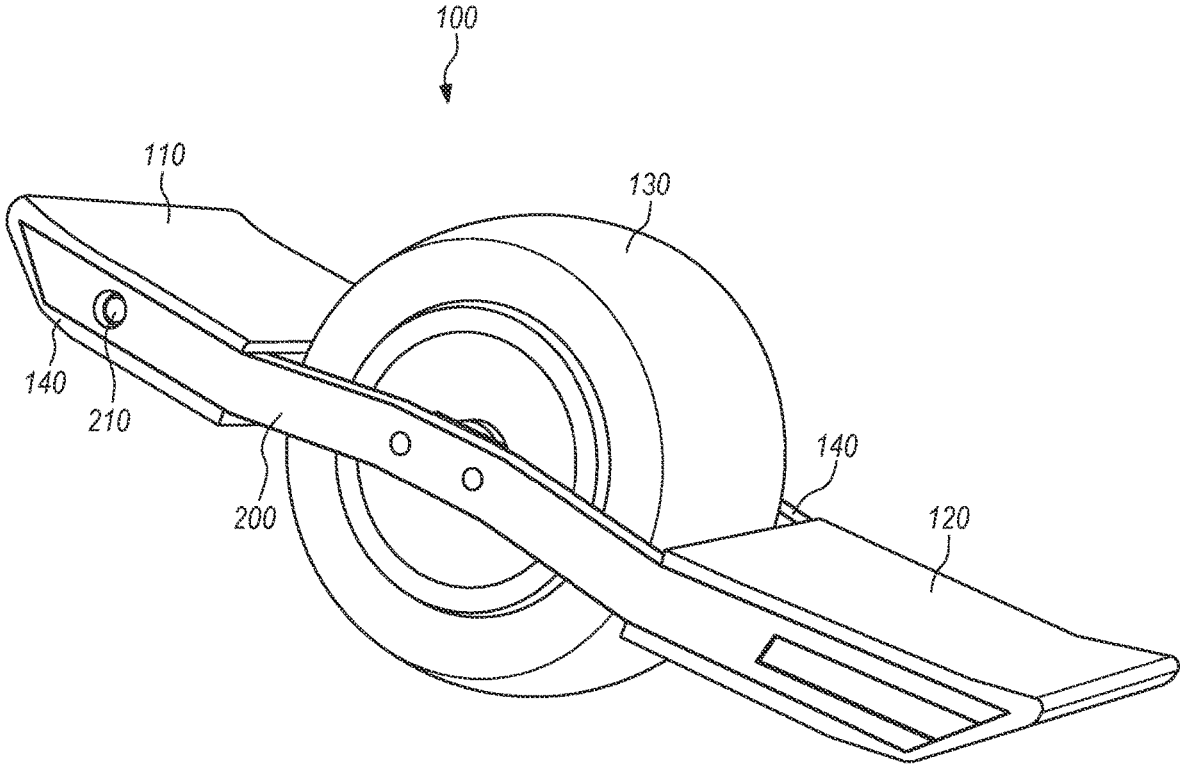
FIG. 1 shows the left-side angled rail and right-side angled rail installed on a Onewheel®.

As shown in FIG. 1, left-side angled rail 200 and right-side angled rail 400 are installed on a one-wheeled electric skateboard 100 with front footpad 110, back footpad 120, wheel 130, front bumper 140, rear bumper 150, and charger hole 210.

Figure 2:
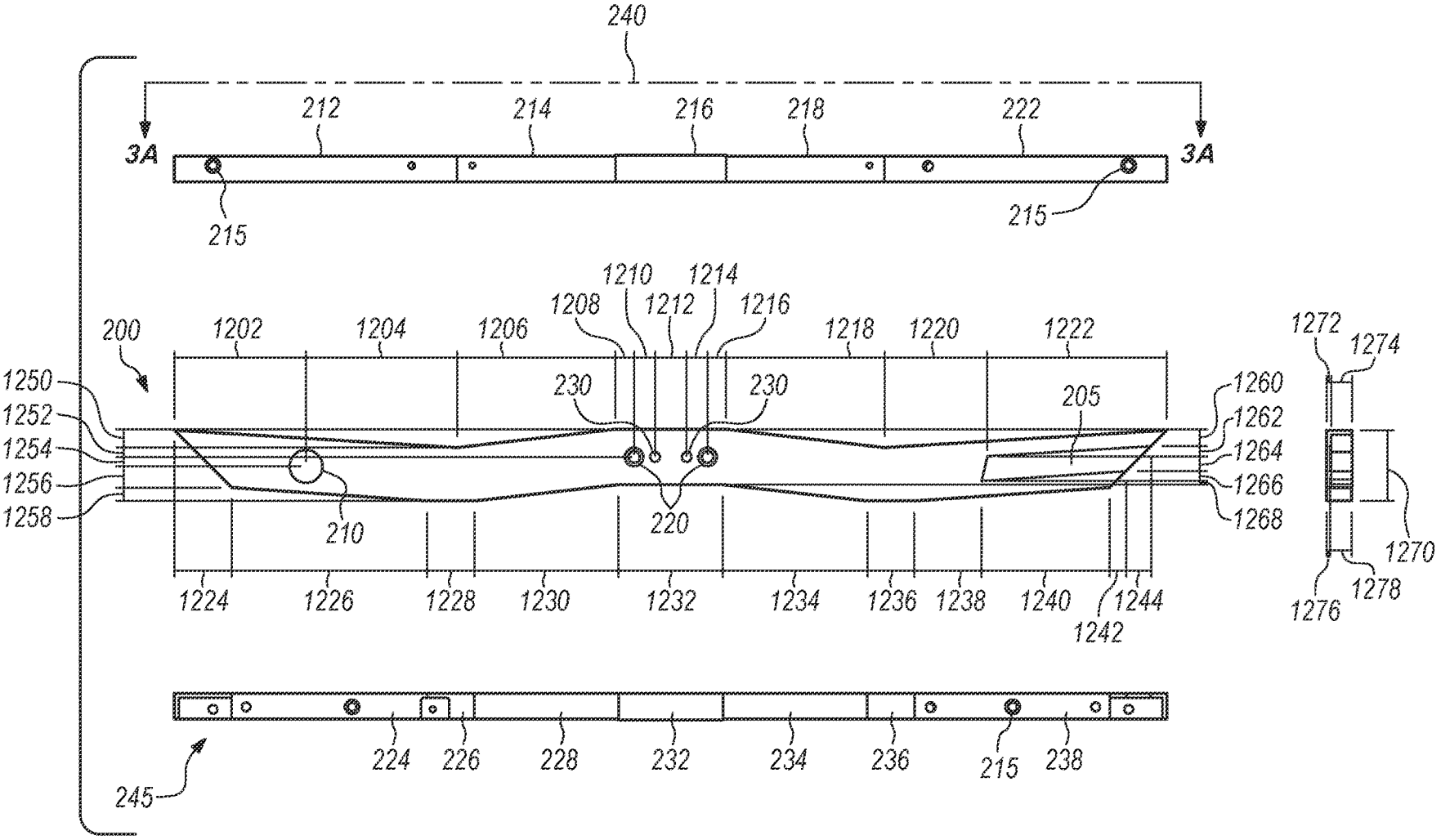
FIG. 2 shows a side-view of the left-side angled rail with left-top section and left-bottom section.
Figures 3A, 3B, 3C, 3D, 3E, 3F, 3G, 3H, 3J:
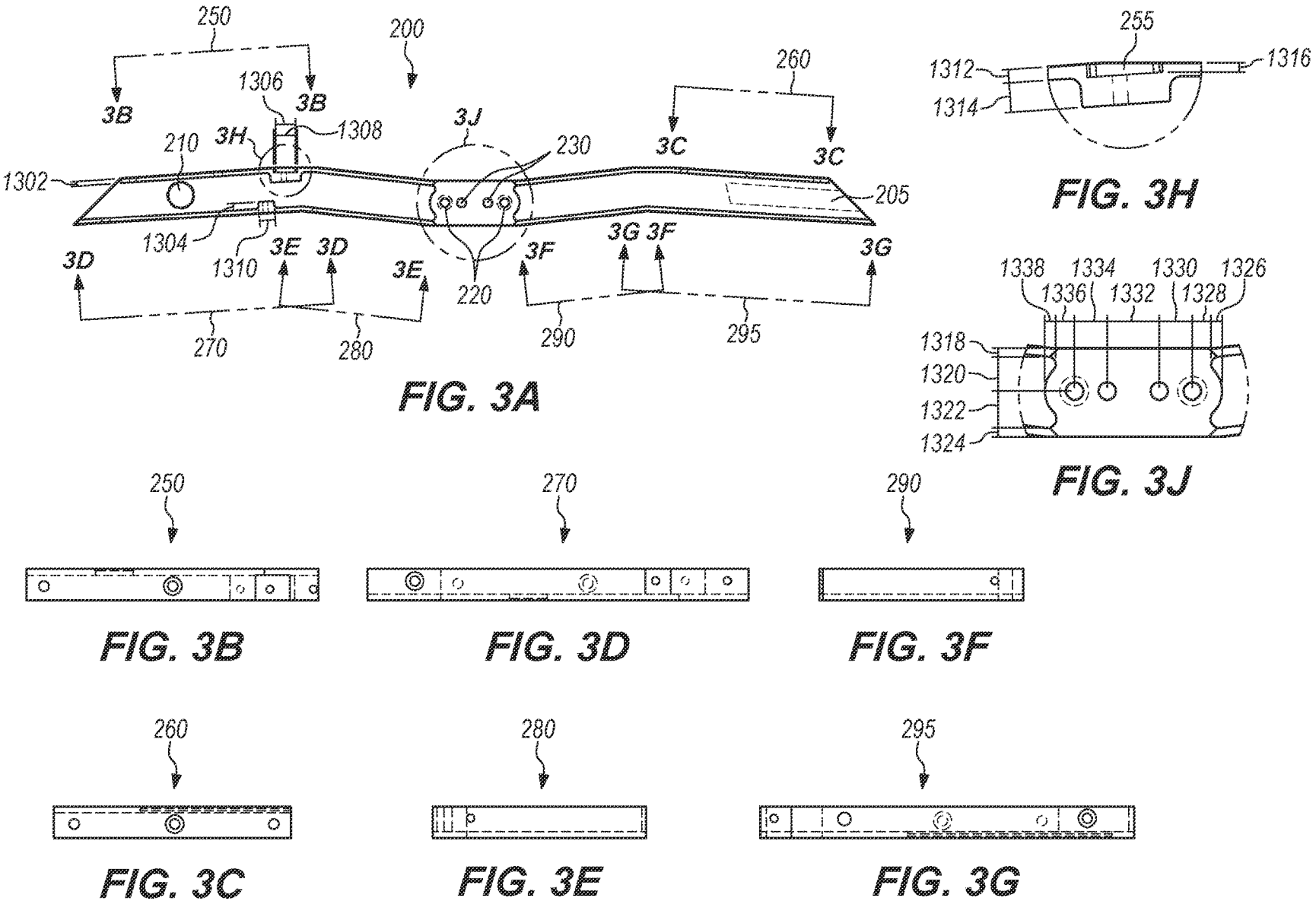
FIG. 3A shows a side-view of the left-side angled rail.
FIG. 3B shows a top-view of a section of the left-side angled rail.
FIG. 3C shows a top-view of another section of the left-side angled rail.
FIG. 3D shows a bottom-view of a section of the left-side angled rail.
FIG. 3E shows a bottom-view of another section of the left-side angled rail.
FIG. 3F shows a bottom-view of another section of the left-side angled rail.
FIG. 3G shows a bottom-view of another section of the left-side angled rail.
FIG. 3H shows a side-view of a section of the left-side angled rail.
FIG. 3J shows a side-view of another section of the left-side angled rail.

FIG. 2 shows left-side angled rail 200 with left-top section A-A 240 and left-bottom section 245. Left-side angled rail 200 includes charger hole 210. Left-top section A-A 240 includes first left top-subsection 212, second left top-sub-section 214, third left top-subsection 216, fourth left top-subsection 218, and fifth left top-subsection 222. Left-bottom section 245 includes first left bottom-subsection 224, second left bottom sub-section 226, third left bottom sub-section 228, fourth left bottom sub-section 232, fifth left bottom sub-section 234, sixth bottom left sub-section 236, and seventh left bottom sub-section 238.

Left-top section 3A-3A 240 and left-bottom section 245 of left-side angled rail 200 also include various holes 215 for connection with front footpad 110, back footpad 120, front bumper 140, rear bumper 150, and other accessories such as a wheel guards, fenders, plates, covers, and others.

Left-side angled rail 200 also includes wheel holes 220 and wheel pin holes 230 for connection with the axil of wheel 130. In one embodiment, left-side angled rail 200 also includes slot 205 for inserts.

Turning to FIGS. 3A-3H and 3J, left-side angled rail 200 is shown with left top-section 3B-3B 250, left top-section 3C-3C 260, left bottom-section 3D-3D 270, left bottom-section 3E-3E 280, left bottom-section 3F-3F 290, and left bottom-section 3G-3G 295. Left-side angled rail 200 also includes left-footpad notch 255 for mounting front footpad 110.

In one embodiment, all relative to the x-axis, left top-section 3B-3B 250 is rotated up approximately 3.7 degrees, left top-section 3C-3C 260 is rotated up approximately 3.7 degrees, left bottom-section 3D-3D 270 is rotated up approximately 3.7 degrees, left bottom-section 3E-3E 280 is rotated down approximately 6.55, left bottom-section 3F-3F 290 is rotated down approximately 6.55 degrees, and left bottom-section G-G 295 is rotated up approximately 3.7 degrees. This rotation produces a net five-degree downward tilt after the wheel connection points, and then a five degree up-ward tilt before the footpad deck attachment points.

However, in other embodiments, other degree rotations can also be used to achieve the five-degree downward tilt after the wheel connection points, and then the five degree up-ward tilt before the footpad deck attachment points. And, in yet other further embodiments, other degree rotations can also be used to achieve the desired downward tilt after the wheel connection points, and then the corresponding up-ward tilt before the footpad deck attachment points.

In one example embodiment, left-side angled rail 200 has dimensions and tolerances as shown in FIGS. 2 and 3A-3H and 3J. In one embodiment, left-side angled rail 200 has dimensions 1202, 1204, 1206, 1208, 1210, 1212, 1214, 1216, 1218, 1220, 1222, 1224, 1226, 1228, 1230, 1232, 1234, 1236, 1238, 1240, 1242, 1244, 1250, 1252, 1254, 1256, 1258, 1260, 1262, 1264, 1266, 1268, 1270, 1272, 1274, 1276, 1278, 1302, 1304, 1306, 1308, 1310, 1312, 1314, 1316, 1318, 1320, 1322, 1324, 1326, 1328, 1330, 1332, 1334, 1336, and 1338.

In one embodiment, left-side angled rail 200 has dimension 1202 of approximately 3.586 inches, dimension 1204 of approximately 4.097 inches, dimension 1206 of approximately 4.331 inches, dimension 1208 of approximately 0.505 inches, dimension 1210 of approximately 0.563 inches, dimension 1212 of approximately 0.875 inches, dimension 1214 of approximately 0.562 inches, dimension 1216 of approximately 0.505 inches, dimension 1218 of approximately 4.331 inches, dimension 1220 of approximately 2.788 inches, dimension 1222 of approximately 4.895 inches, dimension 1224 of approximately 1.569 inches, dimension 1226 of approximately 5.341 inches, dimension 1228 of approximately 1.268 inches, dimension 1230 of approximately 3.922 inches, dimension 1232 of approximately 2.838 inches, dimension 1234 of approximately 3.992 inches, dimension 1236 of approximately 1.268 inches, dimension 1238 of approximately 1.846 inches, dimension 1240 of approximately 3.495 inches, dimension 1242 of approximately 0.459 inches, dimension 1244 of approximately 0.661 inches, dimension 1250 of approximately 0.497 inches, dimension 1252 of approximately 0.253 inches, dimension 1254 of approximately 0.264 inches, dimension 1256 of approximately 0.591 inches, dimension 1258 of approximately 0.345 inches, dimension 1260 of approximately 0.465 inches, dimension 1262 of approximately 0.252 inches, dimension 1264 of approximately 0.422 inches, dimension 1266 of approximately 0.291 inches, dimension 1268 of approximately 0.07 inches, dimension 1270 of approximately 1.95 inches, dimension 1272 of approximately 0.14 inches, dimension 1274 of approximately 0.58 inches, dimension 1276 of approximately 0.09 inches, dimension 1278 of approximately 0.61 inches, dimension 1302 of approximately 0.125 inches, dimension 1304 of approximately 0.375 inches, dimension 1306 of approximately 0.775 inches, dimension 1308 of approximately 1.0 inches, dimension 1310 of approximately 0.50 inches, dimension 1312 of approximately 0.125 inches, dimension 1314 of approximately 0.375 inches, dimension 1316 of approximately 0.085 inches, dimension 1318 of approximately 0.125 inches, dimension 1320 of approximately 0.625 inches, dimension 1322 of approximately 0.625 inches, dimension 1324 of approximately 0.125 inches, dimension 1326 of approximately 0.247 inches, dimension 1328 of approximately 0.258 inches, dimension 1330 of approximately 0.562 inches, dimension 1332 of approximately 0.875 inches, dimension 1334 of approximately 0.563 inches, dimension 1336 of approximately 0.258 inches, and dimension 1338 of approximately 0.247 inches.

However, in other embodiments, other dimensions and tolerances can be used relative to and as necessitated by the specific model of self-stabilizing, one-wheeled electric skateboard or other related product, and desired attachments and accessories thereto.

Figure 4:
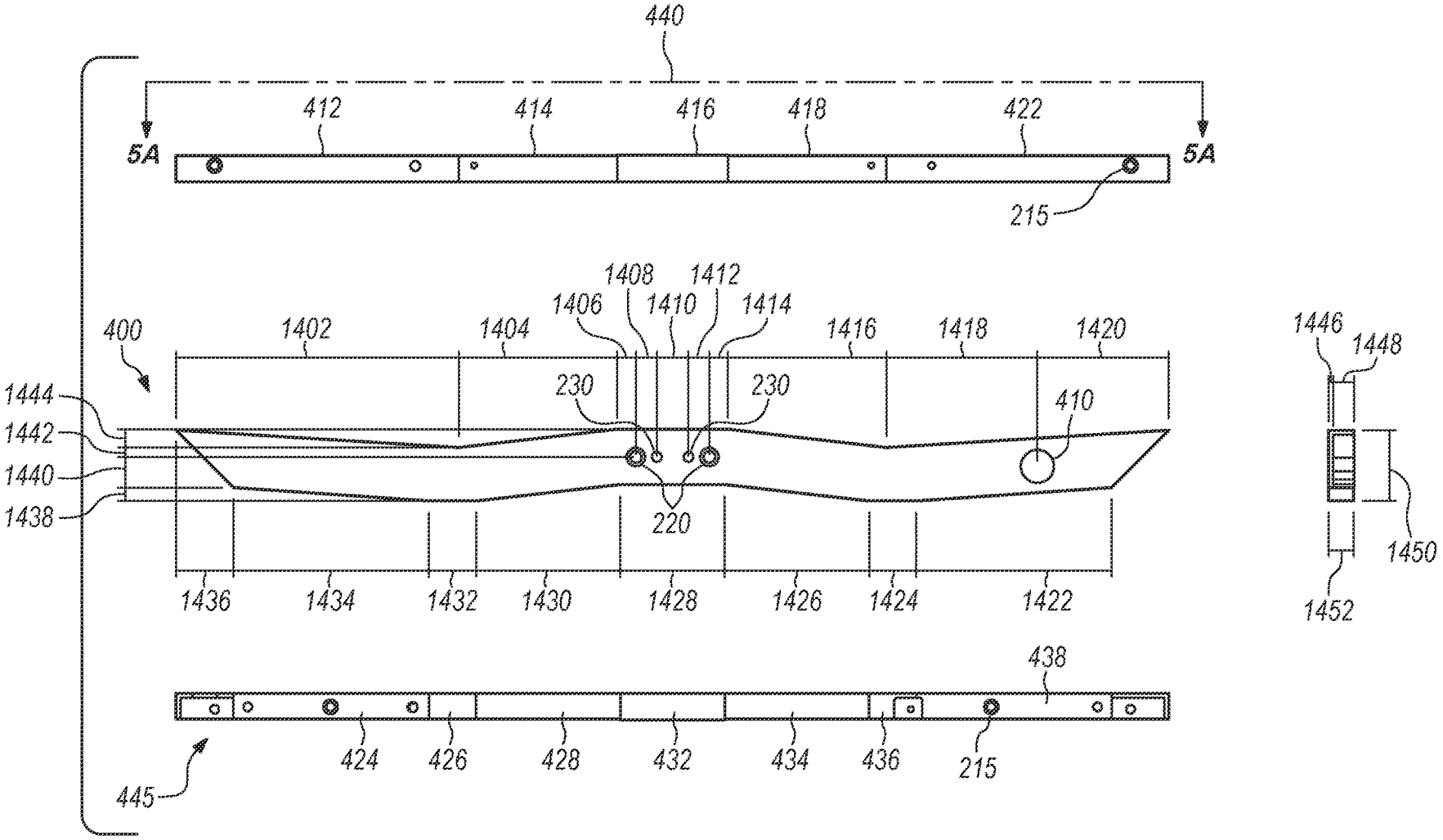
FIG. 4 shows a side-view of the right-side angled rail with right-top section and right-bottom section.
Figures 5A, 5B, 5C, 5D, 5E, 5F, 5G, 5H, 5J, 5K:
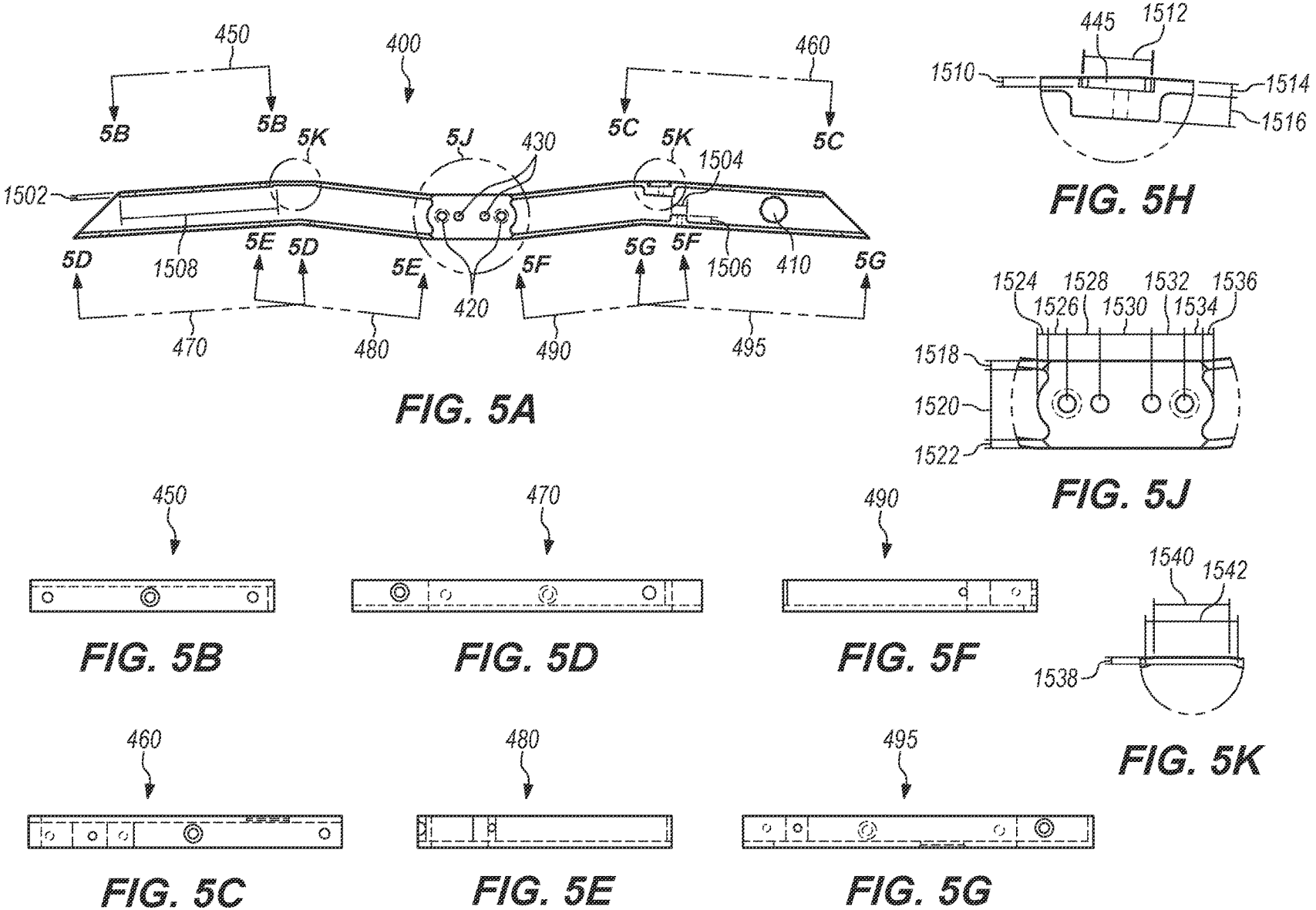
FIG. 5A shows a side-view of the right-side angled rail.
FIG. 5B shows a top-view of a section of the right-side angled rail.
FIG. 5C shows a top-view of another section of the right-side angled rail.
FIG. 5D shows a bottom-view of a section of the right-side angled rail.
FIG. 5E shows a bottom-view of another section of the right-side angled rail.
FIG. 5F shows a bottom-view of another section of the right-side angled rail.
FIG. 5G shows a bottom-view of another section of the right-side angled rail.
FIG. 5H shows a side-view of a section of the right-side angled rail.
FIG. 5J shows a side-view of another section of the right-side angled rail.
FIG. 5K shows a side-view of another section of the right-side angled rail.

FIG. 4 shows right-side angled rail 400 with right-top section 5A-5A 440 and right-bottom section 445. Right-side angled rail 400 includes charger hole 410. Right-top section 5A-5A 440 includes first right top-subsection 412, second right top-subsection 414, third right top-subsection 416, fourth right top-subsection 418, and fifth right top-subsection 422. Right-bottom section 445 includes first right bottom-subsection 424, second right bottom sub-section 426, third right bottom sub-section 428, fourth right bottom sub-section 432, fifth right bottom sub-section 434, sixth right bottom sub-section 436, and seventh right bottom sub-section 438.

Right-top section A-A 440 and right-bottom section 445 include various holes 215 for connection with front footpad 110, back footpad 120, front bumper 140, rear bumper 150, and other accessories such as a wheel guards, fenders, plates, covers, and others. Right-side angled rail 400 also includes wheel holes 220 and wheel pin holes 230 for connection with the axil of the wheel 130.

Turning to FIGS. 5A-5H and 5J-5K, right-side angled rail 400 is shown with right top-section 5B-5B 450, right top-section 5C-5C 460, right bottom-section 5D-5D 470, right bottom-section 5E-5E 480, right bottom-section 5F-5F 490, and right bottom-section 5G-5G 495. Right-side angled rail 400 also includes right-footpad notch 455 for mounting front footpad 110.

In one embodiment, all relative to the x-axis, right top-section 5B-5B 450 is rotated up approximately 3.7 degrees, right top-section 5C-5C 460 is rotated up approximately 3.7 degrees, right bottom-section 5D-5D 470 is rotated up approximately 3.7 degrees, right bottom-section 5E-5E 480 is rotated down approximately 6.55, right bottom-section 5F-5F 490 is rotated down approximately 6.55 degrees, and right bottom-section 5G-5G 495 is rotated up approximately 3.7 degrees. This rotation produces a net five-degree downward tilt after the wheel connection points, and then a five degree up-ward tilt before the footpad deck attachment points.

However, in other embodiments, other degree rotations can also be used to achieve the five-degree downward tilt after the wheel connection points, and then the five degree up-ward tilt before the footpad deck attachment points. And, in yet other further embodiments, other degree rotations can also be used to achieve the desired downward tilt after the wheel connection points, and then the corresponding up-ward tilt before the footpad deck attachment points.

In one example embodiment, right-side angled rail 400 has dimensions and tolerances in inches as shown in FIGS. 4 and 5A-5H and 5J-5K. In one embodiment, right-side angled rail 400 has 1402, 1404, 1406, 1408, 1410, 1412, 1414, 1416, 1418, 1420, 1422, 1424, 1426, 1428, 1430, 1432, 1434, 1436, 1438, 1440, 1442, 1444, 1446, 1448, 1450, 1502, 1504, 1506, 1508, 1510, 1512, 1514, 1516, 1518, 1520, 1522, 1524, 1526, 1528, 1530, 1532, 1534, 1536, 1538, 1540, 1542, and 1544.

In one embodiment, right-side angled rail 400 has dimension 1402 of approximately 7.683 inches, dimension 1404 of approximately 4.331 inches, dimension 1406 of approximately 0.505 inches, dimension 1408 of approximately 0.563 inches, dimension 1410 of approximately 0.875 inches, dimension 1412 of approximately 0.862 inches, dimension 1414 of approximately 0.505 inches, dimension 1416 of approximately 4.331 inches, dimension 1418 of approximately 4.42 inches, dimension 1420 of approximately 3.263 inches, dimension 1422 of approximately 5.341 inches, dimension 1424 of approximately 1.268 inches, dimension 1426 of approximately 3.922 inches, dimension 1428 of approximately 2.838 inches, dimension 1430 of approximately 3.922 inches, dimension 1432 of approximately 1.268 inches, dimension 1434 of approximately 5.341 inches, dimension 1436 of approximately 1.569 inches, dimension 1438 of approximately 0.345 inches, dimension 1440 of approximately 0.855 inches, dimension 1442 of approximately 0.253 inches, dimension 1444 of approximately 0.497 inches, dimension 1446 of approximately 0.14 inches, dimension 1448 of approximately 0.58 inches, dimension 1450 of approximately 1.95 inches, dimension 1452 of approximately 0.7 inches, dimension 1502 of approximately 0.125 inches, dimension 1504 of approximately 0.5 inches, dimension 1506 of approximately 0.375 inches, dimension 1508 of approximately 5.211 inches, dimension 1510 of approximately 0.085 inches, dimension 1512 of approximately 0.775 inches, dimension 1514 of approximately 0.0125 inches, dimension 1516 of approximately 0.25 inches, dimension 1518 of approximately 0.125 inches, dimension 1520 of approximately 1.25 inches, dimension 1522 of approximately 0.125 inches, dimension 1524 of approximately 0.247 inches, dimension 1526 of approximately 0.258 inches, dimension 1528 of approximately 0.563 inches, dimension 1530 of approximately 0.875 inches, dimension 1532 of approximately 0.562 inches, dimension 1534 of approximately 0.258 inches, dimension 1536 of approximately 0.247 inches, dimension 1538 of approximately 0.095 inches, dimension 1540 of approximately 1.267 inches, and dimension 1542 of approximately 1.548 inches.

However, in other embodiments, other dimensions and tolerances can be used relative to and as necessitated by the specific model of self-stabilizing, one-wheeled electric skateboard or other related product, and desired attachments and accessors thereto.

In one example embodiment, left-side angled rail 200 and right-side angled rail 400 are made from 7075 Aluminum. However, in other embodiments, other similar materials can be used.

The angled frame rails of this invention and disclosure can also be used on other one-wheeled electric skateboards or similar vehicles. For example, in another embodiment, the angled frame rails of this invention and disclosure can also be used with the Trotter MagWheel. The Trotter Magwheel suffers from the same problems as the Onewheel®, so it will benefit in a similar manner.

In other embodiments, the angled frame rails of this invention and disclosure can also be used on the TFL Balance Board. The rails will lower the center of gravity and grip the wobble cushion better and make the TFL Balance Board more beginner friendly. The increased ease of use will allow beginner users to more confidently train and learn to use the TFL Balance Board.

While the invention has been specifically described in connection with certain specific embodiments thereof, it is to be understood that this is by way of illustration and not of limitation. Reasonable variations and modifications are possible within the scope of the foregoing disclosure and drawings without departing from the spirit of the invention.

What is claimed is:

1. A side rail for self-stabilizing one-wheel electric vehicles comprising:

a first section;

a second section, wherein the second section is after the first section;

a third section, wherein the third section is after the second section;

a fourth section, wherein the fourth section is after the third section;

a fifth section, wherein the fifth section is after the fourth section; and wherein the first section is angled up 3.7 degrees relative to the third section, the second section is angled down 6.55 degrees relative to the third section, the fourth section is angled down 6.55 degrees relative to the third section, and the fifth section is angled up 3.7 degrees relative to the third section.

2. The side rail of claim 1 further comprising a charger hole in the first section.

3. The side rail of claim 1 further comprising a footpad notch in the first section for mounting a front footpad.

4. The side rail of claim 1 further comprising a slot in the fifth section for an insert.

5. The side rail of claim 1 further comprising a plurality of holes in the third section for connecting with an axil of a wheel.

6. The side rail of claim 1 further comprising a plurality of holes in the first section for connecting with a front footpad and a plurality of holes in the fifth section for connecting with a back footpad.

7. A side rail for self-stabilizing one-wheel electric vehicles comprising:

a first section;

a second section, wherein the second section is after the first section;

a third section, wherein the third section is after the second section;

a fourth section, wherein the fourth section is after the third section;

a fifth section, wherein the fifth section is after the fourth section; and wherein the first section is angled up relative to the third section, the second section is angled down relative to the third section, the fourth section is angled down relative to the third section, and the fifth section is angled up relative to the third section.

8. The side rail of claim 7 further comprising a charger hole in the first section.

9. The side rail of claim 7 further comprising a footpad notch in the first section for mounting a front footpad.

10. The side rail of claim 7 further comprising a slot in the fifth section for an insert.

11. The side rail of claim 7 further comprising a plurality of holes in the third section for connecting with an axil of a wheel.

12. The side rail of claim 7 further comprising a plurality of holes in the first section for connecting with a front footpad and a plurality of holes in the fifth section for connecting with a back footpad.

* * * * *